US009759494B2

(12) United States Patent
Nilsson et al.

(10) Patent No.: US 9,759,494 B2
(45) Date of Patent: Sep. 12, 2017

(54) HEAT EXCHANGER PLATE AND PLATE HEAT EXCHANGER COMPRISING SUCH A HEAT EXCHANGER PLATE

(71) Applicant: ALFA LAVAL CORPORATE AB, Lund (SE)

(72) Inventors: Johan Nilsson, Ronneby (SE); Magnus Hedberg, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 122 days.

(21) Appl. No.: 14/428,390

(22) PCT Filed: Oct. 10, 2013

(86) PCT No.: PCT/EP2013/071150
§ 371 (c)(1),
(2) Date: Mar. 16, 2015

(87) PCT Pub. No.: WO2014/067758
PCT Pub. Date: May 8, 2014

(65) Prior Publication Data

US 2015/0247682 A1 Sep. 3, 2015

(30) Foreign Application Priority Data

Oct. 30, 2012 (EP) ..... 12190496

(51) Int. Cl.
*F28F 3/08* (2006.01)
*F28D 9/00* (2006.01)
*F28F 3/04* (2006.01)

(52) U.S. Cl.
CPC ..... *F28F 3/08* (2013.01); *F28D 9/005* (2013.01); *F28D 9/0043* (2013.01); *F28F 3/046* (2013.01); *F28F 3/083* (2013.01)

(58) Field of Classification Search
CPC ..... F28D 9/0043; F28D 9/005
(Continued)

(56) References Cited

U.S. PATENT DOCUMENTS 3,258,832 A 7/1966 Gerstung
3,862,661 A * 1/1975 Kovalenko et al. .... F28F 3/083 165/166
(Continued)

FOREIGN PATENT DOCUMENTS

GB 464 004 A 4/1937
GB 1 565 817 A 4/1980
(Continued)

OTHER PUBLICATIONS

International Search Report (PCT/ISA/210) mailed on Nov. 20, 2013, by the European Patent Office as the International Searching Authority for International Application No. PCT/EP2013/071150.
(Continued)

*Primary Examiner* — Allen Flanigan
(74) *Attorney, Agent, or Firm* — Buchanan Ingersoll & Rooney PC

(57) ABSTRACT

A heat exchanger plate has a vertical center axis dividing the plate into a left and a right half delimited by a first and second long side, respectively. A horizontal center axis divides the plate into an upper and a lower half delimited by a first and second short side, respectively. The plate includes a port hole with a reference point that coincides with a center point of a biggest imaginary circle that can be fitted into the port hole. The port hole is arranged within the left half and the upper half. The porthole has a form defined by a number of corner points of an imaginary plane geometric figure of which at least one is displaced from an arc of the circle, and
(Continued)

the same number of thoroughly curved lines connecting the corner points. The corner points include first, second and third corner points.

7 Claims, 3 Drawing Sheets

(58) Field of Classification Search
USPC ..... 165/167
See application file for complete search history.

(56) References Cited

U.S. PATENT DOCUMENTS

| | | | | |
|---|---|---|---|---|
| 4,182,411 | A | 1/1980 | Sumitomo et al. | |
| 5,727,623 | A * | 3/1998 | Yoshioka et al. | B01D 53/265 165/113 |
| 5,832,736 | A * | 11/1998 | Yoshioka et al. | F25B 39/022 165/167 |
| 6,318,456 | B1 * | 11/2001 | Brenner | F28D 9/0018 165/133 |
| 8,794,303 | B2 | 8/2014 | Yamada | |
| 9,228,784 | B2 | 1/2016 | Reif et al. | |
| 2006/0032621 | A1 * | 2/2006 | Martin et al. | F28F 9/026 165/167 |
| 2007/0089283 | A1 | 4/2007 | Wilson et al. | |
| 2007/0107890 | A1 * | 5/2007 | Geskes et al. | F28D 9/005 165/167 |
| 2008/0210414 | A1 | 9/2008 | Blomgren et al. | |
| 2008/0223564 | A1 * | 9/2008 | Bjornsson et al. | F28D 9/005 165/167 |
| 2010/0181055 | A1 | 7/2010 | Yamada | |
| 2011/0139419 | A1 * | 6/2011 | Blomgren et al. | F28D 9/005 165/170 |
| 2012/0012291 | A1 * | 1/2012 | Ito et al. | F28F 9/026 165/166 |
| 2013/0126137 | A1 * | 5/2013 | Velte | F28D 9/005 165/167 |
| 2015/0253087 | A1 | 9/2015 | Hedberg et al. | |
| 2015/0276319 | A1 | 10/2015 | Hedberg et al. | |
| 2015/0330720 | A1 | 11/2015 | Hedberg et al. | |

FOREIGN PATENT DOCUMENTS

| | | | |
|---|---|---|---|
| JP | 9-072685 | A | 9/1995 |
| JP | 9-217993 | A | 8/1997 |
| JP | H11-051581 | A | 2/1999 |
| JP | 11-173772 | A | 7/1999 |
| JP | 2007-528978 | A | 10/2007 |
| JP | 2009-500588 | A | 1/2009 |
| JP | 2011-524513 | A | 9/2011 |
| RU | 2 042 911 | C1 | 8/1995 |
| RU | 2 432 541 | C2 | 10/2011 |
| WO | 01/67021 | A1 | 9/2001 |
| WO | WO 2005/088221 | A1 | 9/2005 |
| WO | WO 2007/004939 | A1 | 1/2007 |
| WO | 2007/142590 | A1 | 12/2007 |
| WO | 2009/013801 | A1 | 1/2009 |
| WO | WO 2009/154543 | A1 | 12/2009 |
| WO | 2010/106717 | A1 | 9/2010 |
| WO | 2011/003496 | A2 | 1/2011 |

OTHER PUBLICATIONS

Written Opinion (PCT/ISA/237) mailed on Nov. 20, 2013, by the European Patent Office as the International Searching Authority for International Application No. PCT/EP2013/071150.

An English Translation of the Office Action (Notice of Reasons for Rejection) issued on Apr. 4, 2016, by the Japanese Patent Office in corresponding Japanese Patent Application No. 2015-538364. (6 pages).

An English Translation of the Office Action (Notice of Preliminary Rejection) issued on Jul. 6, 2016, by the Korean Patent Office in corresponding Korean Patent Application No. 10-2015-7013944. (7 pages).

* cited by examiner

HEAT EXCHANGER PLATE AND PLATE HEAT EXCHANGER COMPRISING SUCH A HEAT EXCHANGER PLATE

TECHNICAL FIELD

The invention relates to a heat exchanger plate according to the preamble of claim 1. The invention also relates to a plate heat exchanger comprising such a heat exchanger plate.

BACKGROUND ART

Plate heat exchangers typically consist of two end plates in between which a number of heat transfer plates are arranged in an aligned manner. In one type of well-known PHEs, the so called gasketed plate heat exchangers, gaskets are arranged between the heat transfer plates. The end plates, and therefore the heat transfer plates, are pressed towards each other whereby the gaskets seal between the heat transfer plates. The gaskets define parallel flow channels between the heat transfer plates through which channels two fluids of initially different temperatures alternately can flow for transferring heat from one fluid to the other.

The fluids enter and exit the channels through inlet and outlet ports, respectively, which extend through the plate heat exchanger and are formed by respective aligned port holes in the heat transfer plates. The inlet and outlet ports communicate with inlets and outlets, respectively, of the plate heat exchanger. Equipment like pumps is required for feeding the two fluids through the plate heat exchanger. The smaller the inlet and outlet ports are, the larger the pressure drop of the fluids inside the PHE gets and the more powerful, and thus expensive, equipment is required for proper operation of the PHE. Naturally, the diameter of the inlet and outlet ports could be made larger in order to decrease the pressure drop of the fluids and enable use of less powerful equipment. However, enlarging the diameter of the inlet and outlet ports means increasing the diameter of the of the port holes in the heat transfer plates. In turn, this could result in that valuable heat transfer surface of the heat transfer plate must be sacrificed which is typically associated with a lowered heat transfer efficiency of the plate heat exchanger.

SUMMARY

An object of the present invention is to provide a heat exchanger plate that is associated with a relatively low pressure drop and therefore can be used in connection with also relatively less powerful peripheral equipment. The basic concept of the invention is to provide the heat exchanger plate with at least one non-circular port hole instead of a conventional circular one. The port hole can be adapted to the design of the very heat exchanger plate and the port hole area can be enlarged by sacrificing surface of the heat exchanger plate that does not contribute considerably to the heat transfer performance of the heat exchanger plate. Another object of the present invention is to provide a plate heat exchanger comprising such a heat exchanger plate. The heat exchanger plate and the plate heat exchanger for achieving the objects above are defined in the appended claims and discussed below.

A heat exchanger plate according to the present invention has a vertical center axis that divides the heat exchanger plate into a left and a right half delimited by a first and second long side, respectively, and a horizontal center axis that divides the heat exchanger plate into an upper and a lower half delimited by a first and second short side, respectively. Further the heat exchanger plate has a port hole with a reference point which coincides with a center point of a biggest imaginary circle that can be fitted into the port hole. The port hole is arranged within the left half and the upper half of the heat exchanger plate. The heat exchanger plate is characterized in that the porthole has a form defined by a number of corner points of an imaginary plane geometric figure, of which at least one corner point is displaced from an arc of the circle, and the same number of thoroughly curved lines connecting these corner points. A first corner point of the corner points is arranged closest to a transition between the first short side and the first long side and on a first distance from the reference point. A second one of the corner points is arranged closest to the first corner point in a clockwise direction and on a second distance from the reference point. Further, a third one of the corner points is arranged closest to the first corner point in a counter clockwise direction and on a third distance from the reference point.

The term "heat exchanger plate" as used herein is meant to include both the end plates and the heat transfer plates of the plate heat exchanger even if focus herein will be on the heat transfer plates.

The plane geometric figure can be of many different types, for example a triangle, a quadrangle, a pentagon and so on. Thus, the number of corner points or extreme points, and thus curved lines, may differ from being two and up.

By thoroughly curved lines is meant lines that have no straight parts. Thus, the port hole will have a contour without any straight portions. This is beneficial since it will result in relatively low bending stresses around the port hole. A fluid flowing though the port hole strives to bend the port hole into a circular form. Thus, if the port hole had straight portions, that would result in relatively high bending stresses in the heat exchanger plate.

Each of the curved lines connects two of the corner points.

Since at least one of the corner points is displaced from the arc of the imaginary circle, the port hole will be non-circular.

The feature that the second and third corner points are closest to the first corner point in a clockwise and a counter clockwise direction, respectively, expresses the relative positioning of the first, second and third corner points following the contour of the port hole.

Talking about the first, the second and the third distance between the reference point and the first, the second and the third corner points, respectively, it is the shortest distance that is in view.

According to one embodiment of the inventive heat exchanger plate, the number of corner points and curved lines is equal to three. In connection therewith, the corresponding plane geometric figure could be a triangle. This embodiment is suitable for many conventional heat exchanger plates with an essentially rectangular shape and the port holes arranged at the corners of heat exchanger plate.

The curved lines may be concave or outwards bulging as seen from the reference point of the port hole. Such a design enables a relatively large port hole area which is associated with a relatively low pressure drop.

The heat exchanger plate may be such that the first, second and third corner points are arranged on first, second and third imaginary straight lines, respectively, which extend from the reference point of the port hole. A first angle between the first and second imaginary straight lines is essentially equal to a third angle between the third and first imaginary straight lines. Further, the heat exchanger plate may be such that the second distance between the second corner point and the reference point is equal to the third distance between the third corner point and the reference point. These designs enable a symmetric port hole where the symmetry axis is parallel to the first imaginary straight line. A symmetric port hole may facilitate manufacturing of the heat exchanger plate.

In accordance with the invention, the first distance between the first corner point and the reference point may be smaller than the second distance between the second corner point and the reference point and/or the third distance between the third corner point and the reference point. Thereby, the shape of the port hole can be adapted to the design of the rest of the heat exchanger plate. More particularly, depending on the heat exchanger plate design, there may be more room for displacing the second and third corner points to increase the port hole area than for displacing the first corner point.

The port hole of the heat exchanger plate may be such that a first curved line of the curved lines, which connects the first and second corner points, and a third curved line of the curved lines, which connects the third and first corner points, are similar but mirror inverted in relation to each other. Such uniform curved lines enable a symmetric port hole where the symmetry axis is parallel to the first imaginary straight line. As mentioned above, a symmetric port hole may facilitate manufacturing of the heat exchanger plate.

Finally, the upper half of the heat exchanger plate may comprise a second area provided with a second corrugation pattern and a third area provided with a third corrugation pattern. The second and third areas are arranged in succession along the vertical center axis of the heat exchanger plate with the second area closest to the first short side and the second area adjoining the third area along a second border line. The second and third corrugation patterns differ from each other. Further, a fourth imaginary straight line extends from the reference point, through one of the corner points and to an end point of the second border line that is arranged closest to the first long side. This design is suitable for many conventional heat exchanger plates since it enables an enlargement of the port hole in a way that minimizes the effect on the heat transfer capability of the heat exchanger plate. This will be illustrated in the detail description section with reference to the drawings.

The plate heat exchanger according to the present invention comprises a heat exchanger plate as described above.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
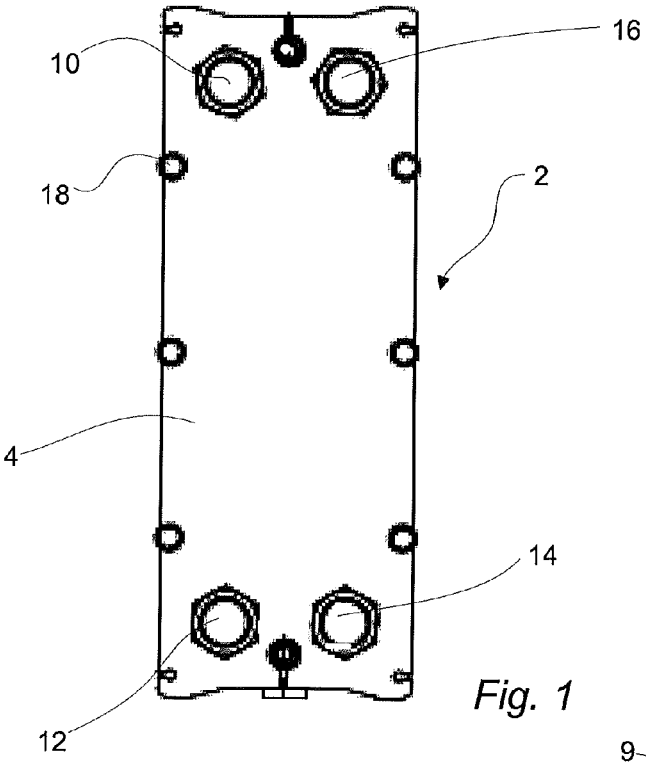
FIG. 1 is a front view of a plate heat exchanger.
Figure 2:
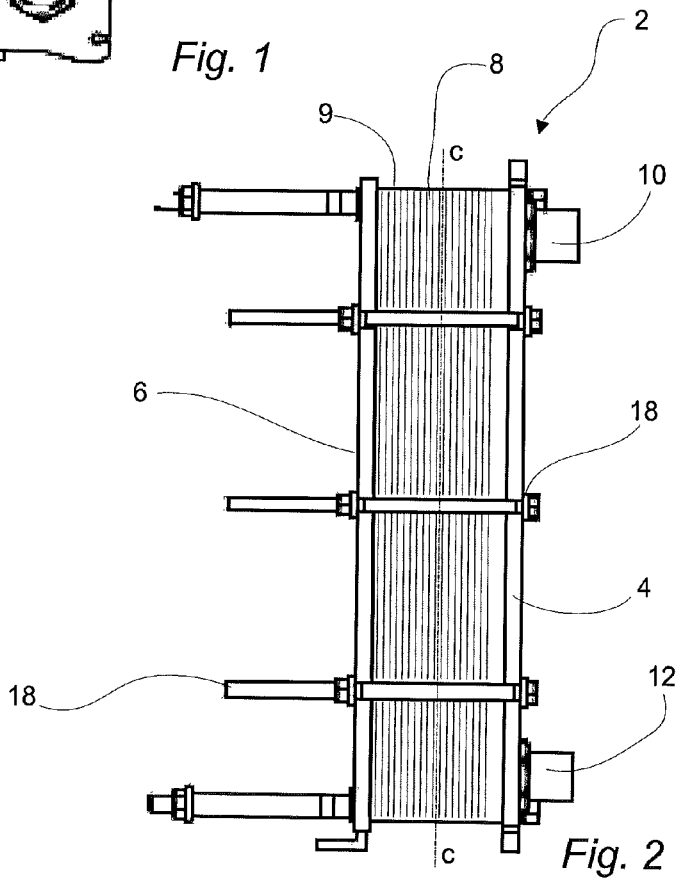
FIG. 2 is a side view of the plate heat exchanger of FIG. 1.

With reference to FIGS. 1 and 2, a gasketed plate heat exchanger 2 is shown. It comprises heat exchanger plates in the form of a first end plate 4, a second end plate 6 and a number of heat transfer plates arranged between the first and second end plates 4 and 6, respectively. The heat transfer plates are of two different types. However, the heat transfer plate parts that the present invention is related to is similar on all heat transfer plates. Therefore, the difference between the two heat transfer plate types will not be discussed further herein. One of the heat transfer plates, denoted 8, is illustrated in further detail in FIG. 3. The different types of heat transfer plates are alternately arranged in a plate pack 9 with a front side (illustrated in FIG. 3) of one heat transfer plate facing the back side of a neighboring heat transfer plate. Every second heat transfer plate is rotated 180 degrees, in relation to a reference orientation (illustrated in FIG. 3), around a normal direction of the figure plane of FIG. 3.

The heat transfer plates are separated from each other by gaskets (not shown). The heat transfer plates together with the gaskets form parallel channels arranged to receive two fluids for transferring heat from one fluid to the other. To this end, a first fluid is arranged to flow in every second channel and a second fluid is arranged to flow in the remaining channels. The first fluid enters and exits the plate heat exchanger 2 through inlet 10 and outlet 12, respectively. Similarly, the second fluid enters and exits the plate heat exchanger 2 through inlet 14 and outlet 16, respectively. For the channels to be leak proof, the heat transfer plates must be pressed against each other whereby the gaskets seal between the heat transfer plates. To this end, the plate heat exchanger 2 comprises a number of tightening means 18 arranged to press the first and second end plates 4 and 6, respectively, towards each other.

Figure 3:
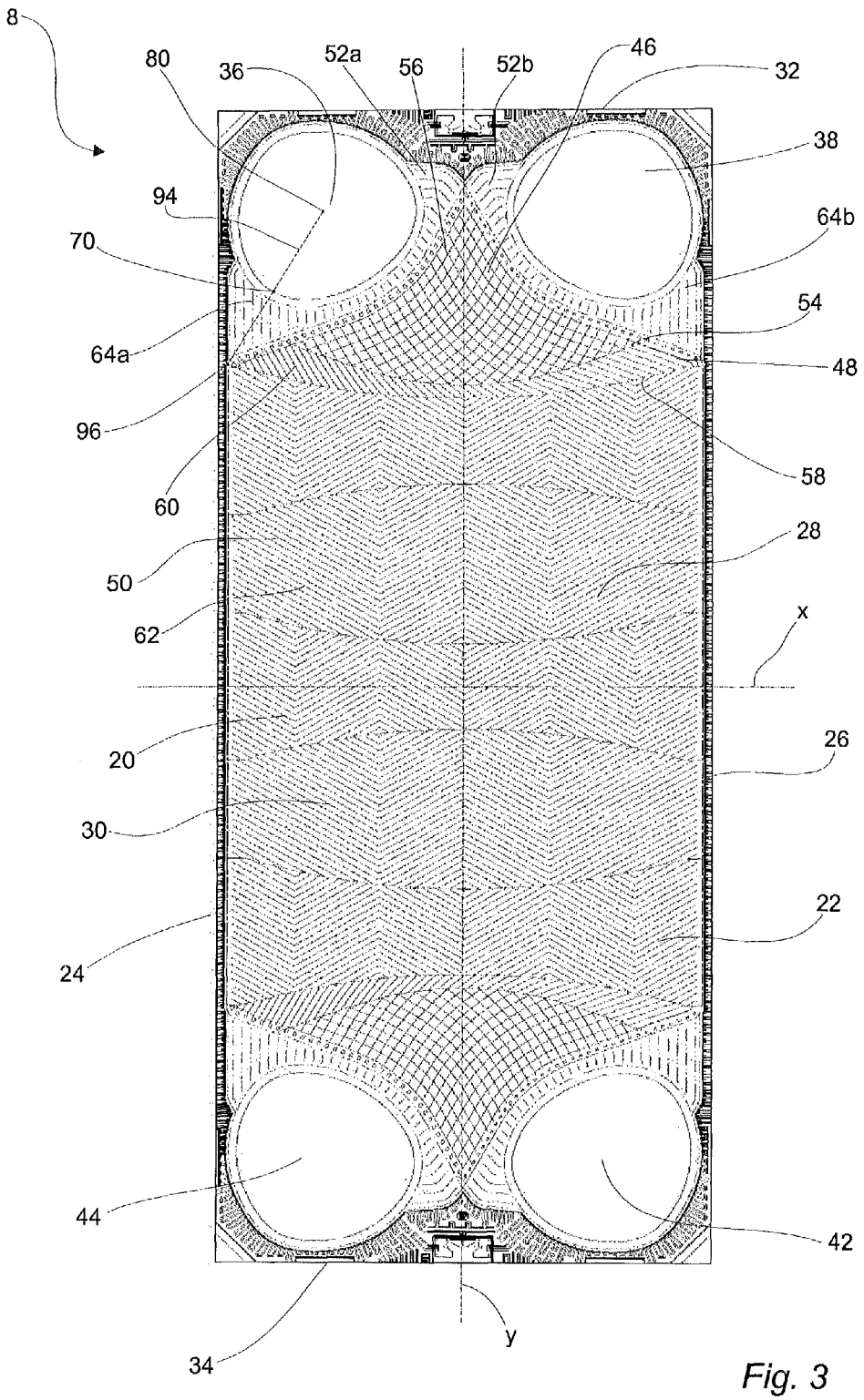
FIG. 3 is a plan view of a heat transfer plate.

The heat transfer plate 8 will now be further described with reference to FIGS. 3 and 4. The heat transfer plate 8 is an essentially rectangular sheet of stainless steel. It has a central extension plane c-c (see FIG. 2) parallel to the figure plane of FIGS. 3 and 4, to a vertical center axis y and to a horizontal center axis x of the heat transfer plate 8. The vertical center axis y divides the heat transfer plate 8 into a first half 20 and a second half 22 having first long side 24 and a second long side 26, respectively. The horizontal center axis x divides the heat transfer plate 8 into an upper half 28 and a lower half 30 having a first short side 32 and a second short side 34, respectively. The upper half 28 of the heat transfer plate 8 comprises an inlet port hole 36 for the first fluid and an outlet port hole 38 for the second fluid connected to the inlet 10 and the outlet 16, respectively, of the plate heat exchanger 2. Similarly, the lower half 30 of the heat transfer plate 8 comprises an inlet port hole 42 for the second fluid and an outlet port hole 44 for the first fluid connected to the inlet 14 and the outlet 12, respectively, of the plate heat exchanger 2. Hereinafter, only the upper half 28 of the plate heat exchanger 2 will be described since the structures of the upper and lower halves, when it comes to the heat transfer plate parts that the present invention relates to, are the same but mirror inverted.

The inlet and outlet port holes 36 and 38 of the upper half 28 are arranged within the first and second halves 20 and 22, respectively. Further, they are similar but mirror inverted which is why only one of them, the inlet port 36, will be further described below. The upper half 28 of the heat transfer plate 8 also comprises a first area 46, a second area 48, a third area 50 and fourth areas 52*a* and 52*b*. The first, second and third areas 46, 48 and 50, respectively, are arranged in succession along the vertical center axis y, as seen from the first short side 32. The first area 46 extends between the inlet and outlet port holes 36 and 38 and adjoins the second area 48 along a first borderline 54. Further, the first area 46 is provided with a first corrugation pattern 56 in the form of a distribution pattern of projections and depressions in relation to the central extension plane c-c. The second area 48 adjoins the third area 50 along a second borderline 58. Further, it is provided with a second corrugation pattern 60 in the form of a transition pattern of projections and depressions in relation to the central extension plane c-c. The third area 50 is provided with a third corrugation pattern 62 in the form of a heat transfer pattern of projections and depressions in relation to the central extension plane c-c. The fourth areas 52*a* and 52*b* extend from a respective one of the inlet and outlet port holes 36 and 38 towards the first and second areas 46 and 48. Further, the fourth areas 52*a* and 52*b* are provided with fourth corrugation patterns 64*a* and 64*b* (similar but mirror inverted) in the form of adiabatic patterns of projections and depressions in relation to the central extension plane c-c. The main task of the first area 46 is to spread a fluid across the entire width of the heat transfer plate 8. The main task of the third area 50 is to transfer heat from a fluid on one side of the heat transfer plate 8 to a fluid on the other side of the heat transfer plate. The second area 48 has both a spreading function as well as a heat transfer function. The main task of the fourth areas 52*a* and 52*b* is to guide a fluid between the inlet and outlet port holes 36 and 38 and the first and second areas 46 and 48, i.e. they are simply areas for fluid transport. The above areas and corrugation patterns will not be described in detail herein. Instead, reference is made to applicant's co-pending patent application "Heat transfer plate and plate heat exchanger comprising such a heat transfer plate", filed on the same date as the present application and hereby incorporated herein.

Figure 4:
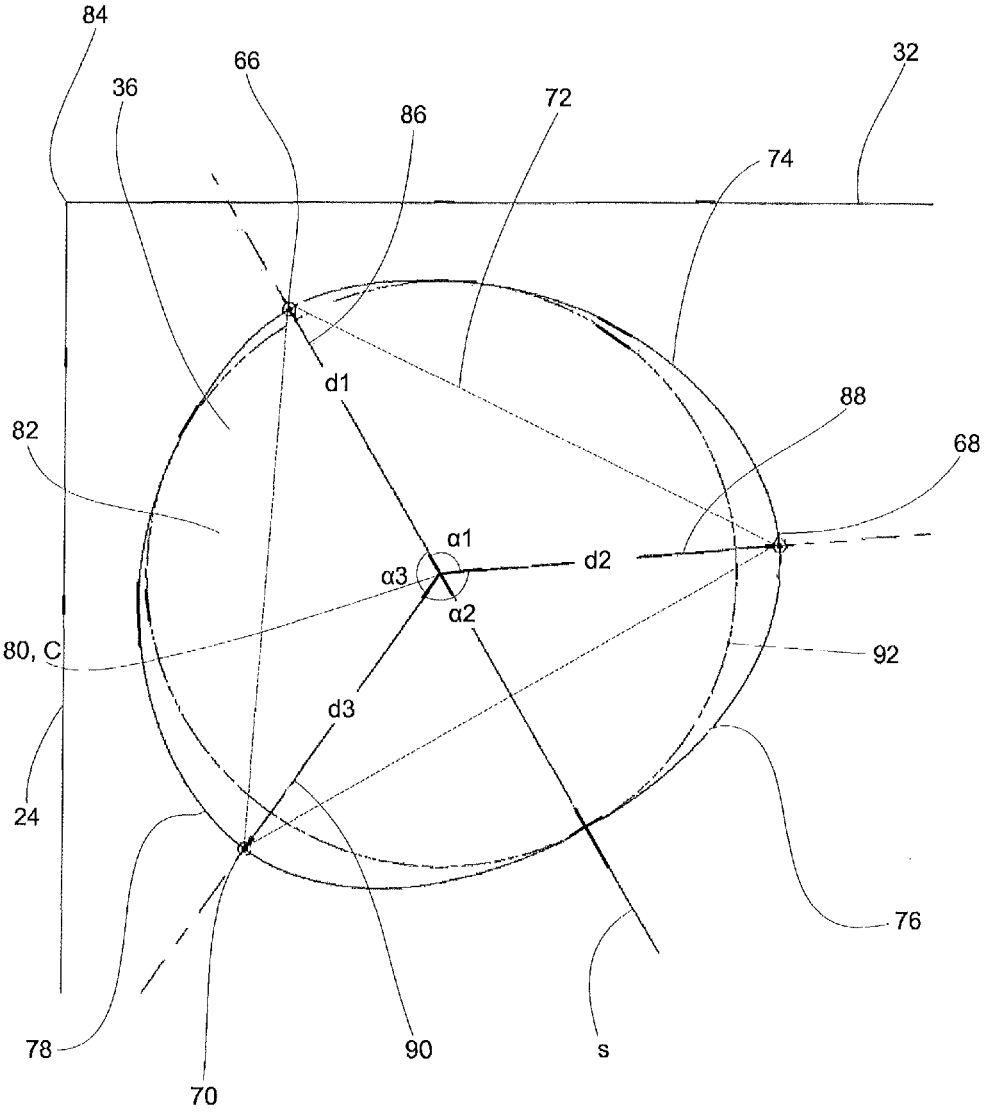
FIG. 4 is a schematic view of a part of the heat transfer plate of FIG. 3.

The inlet port hole 36 is schematically illustrated in FIG. 4. It has a form defined by first, second and third corner points 66, 68 and 70, respectively, of an imaginary triangle 72 (dashed lines). Further, these corner points are connected by first, second and third thoroughly curved lines 74, 76 and 78, respectively, which are concave as seen from within the inlet port hole. A reference point 80 of the inlet port hole 36 coincides with a center point C of a biggest imaginary circle 82 (ghost lines) that can be arranged in the inlet port hole. The first corner point 66 is positioned closest to a transition 84 between the first short side 32 and the first long side 24 of the heat transfer plate 8. Further, it is arranged on a first imaginary straight line 86 extending from the reference point 80 and on a first distance d1 from the reference point. The second corner point 68 is positioned closest to the first corner point in the clockwise direction. Further, it is arranged on a second imaginary straight line 88 extending from the reference point 80 and on a second distance d2 from the reference point. The third corner point 70 is positioned closest to the first corner point in the counter clockwise direction. Further, it is arranged on a third imaginary straight line 90 extending from the reference point 80 and on a third distance d3 from the reference point.

For the above first, second and third distances the following relationships are valid: $d2=d3$ and $d2>d1$. Further, a first angle $\alpha 1$ between the first and second imaginary straight lines is smaller than a second angle $\alpha 2$ between the second and third imaginary straight lines and essentially equal to a third angle $\alpha 3$ between the second and first imaginary straight lines. In other words, for the first, second and third angles the following relationships are valid: $\alpha 1=\alpha 3$ and $\alpha 1<\alpha 2$. In this specific example, $\alpha 1=\alpha 3=115$ degrees. Moreover, the first curved line 74 connecting the first and second corner points 66 and 68 is essentially uniform to the third curved line 78 connecting the third and first corner points 70 and 66. In all, this means that the inlet port hole 36 is symmetric with a single symmetry axis s extending through the first corner point 66 and the reference point 80.

As apparent from the figures and the description above, the inlet port hole 36 does not have a conventional circular form. Instead, it has a form defined by a number of corner points, here three, of which at least one, here all, are displaced from an arc 92 of the circle 82, and the same number of curved lines (here thus three) connecting these corner points. If the inlet port hole was circular, it would preferably have a form corresponding to the circle 82. From a pressure drop point of view, with reference to the previous discussions in this regard, an even larger inlet port hole would be preferable. However, the design of the rest of the heat transfer plate 8, limits the possible size of the inlet port hole. For example, a larger circular inlet port hole would mean that a contour of the inlet port hole would be arranged closer to the first short side 32 and/or the first long side 24 which could result in strength problems of the heat transfer plate 8. Further, a larger circular inlet port hole could also mean that the area between the inlet port hole and the first area 46 (FIG. 3), where a gasket is typically arranged as is well known within the art, could be too narrow for the gasket arrangement. Such a narrow intermediate area could also cause problems in pressing the heat transfer plate with the above referenced corrugation patterns. Naturally, the first area 46 of the heat transfer plate 8 could be displaced further down on the heat transfer plate to make room for a larger circular inlet port hole 36. However, this would typically be associated with a smaller third area 50 and thus a worsened heat transfer capability of the heat transfer plate.

As described above and illustrated in the figures, the area of the inlet port hole can be increased without having to amend the design of the rest of the heat transfer plate. By letting the inlet port hole occupy more of the adiabatic fourth areas 52*a* and 52*b* of the heat transfer plate 8 than a circular inlet port hole with a form corresponding to the circle 82 would do, a larger inlet port hole associated with a smaller pressure drop can be realized. Since it is the adiabatic fourth areas only that are affected by this the enlargement, the distribution and heat transfer capability of the heat transfer plate 8 remains essentially unaffected. More particularly, most room for inlet port hole enlargement exists in a direction coinciding with a fourth imaginary straight line 94 extending from the reference point 80 to an end point 96 of the second borderline 58 that is closest to the first long side 24 of the heat transfer plate 8. Therefore, the heat transfer plate 8 is designed such that the third corner point 70 is arranged on this fourth imaginary straight line 94. Further, since the contour of the inlet port hole 36 lacks straight portions, the bending stresses around the inlet port hole will be relatively low.

It should be stressed that a description corresponding to the one given above is valid for all inlet and outlet port holes of the heat transfer plate.

Another advantage with the above described non-circular inlet port hole concerns gaskets and filters. As described by way of introduction, in a gasketed plate heat exchanger gaskets are used to define and seal the channels between the heat transfer plates. Typically, the gaskets extend both along a periphery of the heat transfer plates to enclose all inlet and outlet port holes and around individual inlet and outlet port holes. The gaskets may comprise grip means arranged for engagement with an edge of the heat transfer plates for securing the gaskets to the heat transfer plates. In connection with some plate heat exchanger applications, for example in applications associated with treatment of fluids contaminated in some way, filter inserts are used to prevent that contaminations come into the channels between the heat transfer plates. These filter inserts typically have the shape of a circular cylinder and they extend through the inlet and/or outlet ports of the plate heat exchanger, i.e. through the inlet and outlet port holes of the heat transfer plates. If, as is conventional, the inlet and outlet port holes of the heat transfer plates are circular, then the grip means of the gaskets may interfere with the filter inserts. However, if the inlet and outlet port holes instead have a form as described above, the gaskets can be adapted such that the gasket grip means engage with the heat transfer plate at the corner points of the inlet and outlet port holes. Thereby, there is no risk of interference between the gaskets and the circular cylindrical filter inserts.

The above described embodiment of the present invention should only be seen as an example. A person skilled in the art realizes that the embodiment discussed can be varied in a number of ways without deviating from the inventive conception.

The end plates 4 and 6 of the above described plate heat exchanger 2 are conventionally designed with circular inlets and outlets. However, also the end plates could be provided with non-circular inlets and outlets similar to the above described inlet and outlet port holes.

Further, above, the form of the inlet port hole is defined by an imaginary plane geometric figure in the form of a triangle, three corner points and three curved lines. Naturally, other imaginary plane geometric figures, and also another number of corner points and curved lines, could be used to define the inlet port hole in alternative embodiments.

The above described inlet port hole is symmetric with a symmetry axis s. Of course, the inlet port hole could instead be completely asymmetric or even more symmetric with more than one symmetry axis. As an example, the curved lines could all be uniform/non-uniform and/or the distance to the reference point for all corner points could be the same/different. Also, the curved lines need not be concave. One or more of the curved lines may have other forms.

The upper half of the above heat transfer plate comprises first, second, third and fourth areas provided with first, second, third and fourth corrugation patterns. Naturally, the invention is just as applicable in connection with a heat transfer plate with an upper half comprising more or less areas. As an example, the upper half of the heat transfer plate could comprise second, third and fourth areas, with second, third and fourth differing corrugation patterns, only, the second area extending all the way from the third area in between the inlet and outlet port holes 36 and 38. For example, the second area could be provided with a distribution pattern, the third area could be provided with a heat transfer pattern and the fourth areas could be provided with adiabatic patterns while the transition pattern could be omitted.

The above described plate heat exchanger is of parallel counter flow type, i.e. the inlet and the outlet for each fluid are arranged on the same half of the plate heat exchanger and the fluids flow in opposite directions through the channels between the heat transfer plates. Naturally, the plate heat exchanger could instead be of diagonal flow type and/or a co-flow type.

Two different types of heat transfer plates are comprised in the plate heat exchanger above. Naturally, the plate heat exchanger could alternatively comprise only one plate type or more than two different plate types. Further, the heat transfer plates could be made of other materials than stainless steel.

Finally, the present invention could be used in connection with other types of plate heat exchangers than gasketed ones, such as plate heat exchangers comprising permanently joined heat transfer plates.

It should be stressed that the attributes first, second, third, etc. is used herein just to distinguish between species of the same kind and not to express any kind of mutual order between the species.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat exchanger plate having a vertical center axis dividing the heat exchanger plate into a left and a right half delimited by a first and second long side, respectively, a horizontal center axis dividing the heat exchanger plate into an upper and a lower half delimited by a first and second short side, respectively, and a port hole with a reference point coinciding with a center point of a biggest imaginary circle that can be fitted into the port hole, the port hole being arranged within the left half and the upper half, wherein the porthole has a form defined by a number of corner points of an imaginary plane geometric figure of which at least one is displaced from an arc of the circle, and the same number of curved lines having no straight parts and connecting the corner points, wherein a first corner point of the corner points is arranged closest to a transition between the first short side and the first long side and on a first distance from the reference point, a second one of the corner points is arranged closest to the first corner point in a clockwise direction and on a second distance from the reference point and a third one of the corner points is arranged closest to the first corner point in a counter clockwise direction and on a third distance from the reference point, the port hole having one symmetry axis only which extends through the first corner point and the reference point.

2. A heat exchanger plate according claim 1, wherein the number of corner points and curved lines is equal to three.

3. A heat exchanger plate according to claim 1, wherein the curved lines are concave seen from the reference point of the port hole.

4. A heat exchanger plate according to claim 1, wherein the first distance between the first corner point and the reference point is smaller than the second distance between the second corner point and the reference point.

5. A heat exchanger plate according to claim 1, wherein the first distance between the first corner point and the reference point is smaller than the third distance between the third corner point and the reference point.

6. A heat exchanger plate according to claim 1, wherein the upper half of the heat exchanger plate comprises a first area provided with a first corrugation pattern, a second area provided with a second corrugation pattern and a third area provided with a third corrugation pattern, the second and third areas being arranged in succession along the vertical center axis of the heat exchanger plate with the second area closest to the first short side, the second area adjoining the third area along a second border line, and the second and third corrugation patterns differing from each other, and wherein a fourth imaginary straight line extends from the reference point, through one of the corner points and to an end point of the second border line that is arranged closest to the first long side.

7. A plate heat exchanger comprising a heat exchanger plate according to claim 1.

* * * * *